US008235359B2

(12) United States Patent
Dyke et al.

(10) Patent No.: US 8,235,359 B2
(45) Date of Patent: Aug. 7, 2012

(54) VEHICLE CRASH ATTENUATOR APPARATUS

(75) Inventors: Gerrit Dyke, Stockton, CA (US); Alvaro E. Morales Flores, Vacaville, CA (US)

(73) Assignee: Barrier Systems, Inc., Vacaville, CA (US)

( * ) Notice: Subject to any disclaimer, the term of this patent is extended or adjusted under 35 U.S.C. 154(b) by 281 days.

(21) Appl. No.: 12/589,664

(22) Filed: Oct. 27, 2009

(65) Prior Publication Data

US 2011/0095250 A1 Apr. 28, 2011

(51) Int. Cl.
*E01F 15/02* (2006.01)

(52) U.S. Cl. ..... 256/13.1; 256/DIG. 1

(58) Field of Classification Search ..... 256/13.1, 256/65.14, DIG. 1; 404/10; 403/2
See application file for complete search history.

(56) References Cited

U.S. PATENT DOCUMENTS

| | | | | |
|---|---|---|---|---|
| 3,385,564 | A * | 5/1968 | Persicke | 256/13.1 |
| 3,981,486 | A * | 9/1976 | Baumann | 256/13.1 |
| 4,915,293 | A * | 4/1990 | Paramski | 232/39 |
| 5,022,782 | A * | 6/1991 | Gertz et al. | 404/6 |
| 5,664,905 | A * | 9/1997 | Thompson et al. | 404/6 |
| 6,076,871 | A * | 6/2000 | Jarvis et al. | 293/123 |
| 6,488,268 | B1 * | 12/2002 | Albritton | 256/13.1 |
| 6,551,011 | B1 * | 4/2003 | Valentine | 404/6 |
| 6,616,368 | B2 * | 9/2003 | Birchler et al. | 404/10 |
| 6,719,484 | B1 * | 4/2004 | Johnson | 404/10 |
| 6,840,706 | B1 * | 1/2005 | Camomilla et al. | 404/6 |
| 6,886,813 | B2 * | 5/2005 | Albritton | 256/13.1 |
| 7,182,320 | B2 * | 2/2007 | Heimbecker et al. | 256/13.1 |
| 7,980,533 | B1 * | 7/2011 | Anderson et al. | 256/13.1 |
| 8,007,198 | B1 * | 8/2011 | La Valley et al. | 404/6 |
| 2004/0262588 | A1 * | 12/2004 | Bronstad | 256/13.1 |
| 2007/0131918 | A1 | 6/2007 | James | |
| 2007/0194292 | A1 * | 8/2007 | Serafin | 256/13.1 |
| 2011/0024707 | A1 * | 2/2011 | Williams et al. | 256/13.1 |
| 2011/0031456 | A1 * | 2/2011 | Von Linsingen-Heintzmann et al. | 256/13.1 |

FOREIGN PATENT DOCUMENTS

| | | | |
|---|---|---|---|
| DE | 3616539 | A1 * | 2/1988 |
| DE | 3827030 | A1 * | 4/1989 |
| GB | 2148358 | A * | 5/1985 |

* cited by examiner

*Primary Examiner* — Joshua Kennedy
(74) *Attorney, Agent, or Firm* — Thomas R. Lampe

(57) ABSTRACT

Crash attenuator guardrail apparatus includes an impact head and a backstop having a cable and guardrails supported by guardrail supports located between the impact head and the backstop. Frictional forces are applied to the cable to control and resist movement of the impact head toward the backstop and provide lateral resistance. The guardrail supports include a base having break away structure and brace members having bends and which shorten or lengthen to absorb energy resulting from vehicle impact.

4 Claims, 9 Drawing Sheets

VEHICLE CRASH ATTENUATOR APPARATUS

TECHNICAL FIELD

This invention relates to vehicle crash attenuator apparatus for positioning along roadways and at other locations for absorbing energy and providing lateral resistance upon impact by a vehicle to redirect the vehicle. More particularly, the invention relates to guardrail support structure of the crash attenuator apparatus.

BACKGROUND OF THE INVENTION

U.S. Patent Application Publication No. US 2007/0131918, published Jun. 14, 2007, relates to an impact head for a guardrail including cable routing means adapted to form a tortuous or convoluted path through which a cable is threaded. The convoluted path that the cable must follow through the impact head of the invention restricts movement of the cable through the head, thereby providing sufficient friction to slow down the movement of the impact head during a vehicle impact.

The above-identified U.S. patent application Publication discusses existing highway guardrail end treatment systems and deficiencies of such systems that the guardrail disclosed in the U.S. patent application Publication addresses.

As noted in the U.S. Patent Publication No. U.S. 2007/0131918, existing highway guardrail end treatment systems include the breakaway cable terminal (BCT), the eccentric loader terminal (ELT), the modified eccentric loader terminal (MELT), the vehicle attenuating terminal (VAT), the extruder terminal (ET 2000 and ET plus), the slotted rail terminal (SRT), the sequential kinking terminal (SKT) and the flared energy absorbing terminal (FLEAT).

Terminal ends (the ends facing oncoming traffic) generally consist of one or more guardrails having a W-shaped cross-section supported by a series of both controlled release terminal (CRT) or frangible posts and standard highway guardrail posts. A cable assembly arrangement may be utilized to anchor the end of the rail to the ground, transferring tensile load developed in a side-on impact by a vehicle to the ground anchor. Generally, the terminal ends have an impact head arrangement that will be the first structural member impacted by an errant vehicle during an end-on impact which is designed to spread or absorb some of the impact energy.

Some terminal ends (such as the ET, SKT and FLEAT) absorb the energy of the impacting vehicle during an end-on or head-on impact by having an impact head that slides down the W-shaped guardrails and breaks away the support posts as it travels down the rails. All of the other above-mentioned terminal ends work on the principal of various weakening devices in the posts and rails to allow an errant vehicle to penetrate the terminal end in a controlled manner and prevent the rails from spearing the vehicle or the vehicle from vaulting or jumping over a relatively stiff terminal end.

As indicated in the above-identified U.S. patent application Publication, all of the above-mentioned guardrail terminal ends are considered to be gating. That is, if the guardrail terminal ends are impacted between the impact head and the "length of need" (where the "length of need" is considered to be the distance from the terminal end to where the guardrail will direct a vehicle during an angled impact) during an angled impact, the terminal end will gate and allow the impacting vehicle to pass through the backside of the terminal end. However this gating effect may have undesirable or unsafe results. As noted above, the guardrail disclosed in the patent application publication 2007/0131918 addresses these problems.

These problems are also addressed by the crash attenuator apparatus disclosed and claimed herein, the apparatus incorporating a number of novel structural elements which cooperate in a unique manner to provide the desired results. The apparatus effectively absorbs and distributes forces caused by vehicular impact whether the vehicle strikes an end of the apparatus head-on or crashes into a side of the apparatus. It can also be utilized to protect or shield errant vehicles from roadside hazards, guardrail and barrier terminals, etc.

U.S. Pat. No. 5,022,782 discloses a vehicle crash barrier in which a wire cable extends along an elongated, collapsible frame. The wire cable extends generally parallel to the frame. Friction brakes are mounted on a front section of the frame to decelerate a vehicle axially striking the frame at the front section. U.S. Pat. No. 5,022,782 does not disclose the advantageous features described and claimed herein.

DISCLOSURE OF INVENTION

The present invention relates to a crash attenuator apparatus including impact head structure attached to the ground and including an impact head located above the ground.

Backstop structure is spaced from the impact head structure and is attached to the ground and extends upwardly from the ground.

Cable extends between the impact head structure and the backstop structure.

A plurality of guardrail supports extending upwardly from the ground are disposed between the impact head structure and the backstop structure, the guardrail supports being spaced from one another. The guardrail support structure is of unique character and includes structural components which cooperate in a unique manner.

Guardrail structure is provided including a plurality of interconnected guardrail sections supported by the guardrail supports, at least some of the guardrail sections being slidably movable relative to one another responsive to movement of the impact head toward the backstop structure. The cable extends along the guardrail structure.

Cable engagement structure is in frictional engagement with the cable and in operative association with the impact head to exert frictional forces on the cable to control and resist movement of the impact head toward the backstop structure caused by a vehicle crashing into the impact head.

Other features, advantages and objects of the present invention will become apparent with reference to the following description and accompanying drawings.

BEST MODE FOR CARRYING OUT THE INVENTION

Figures 1, 2, 3:
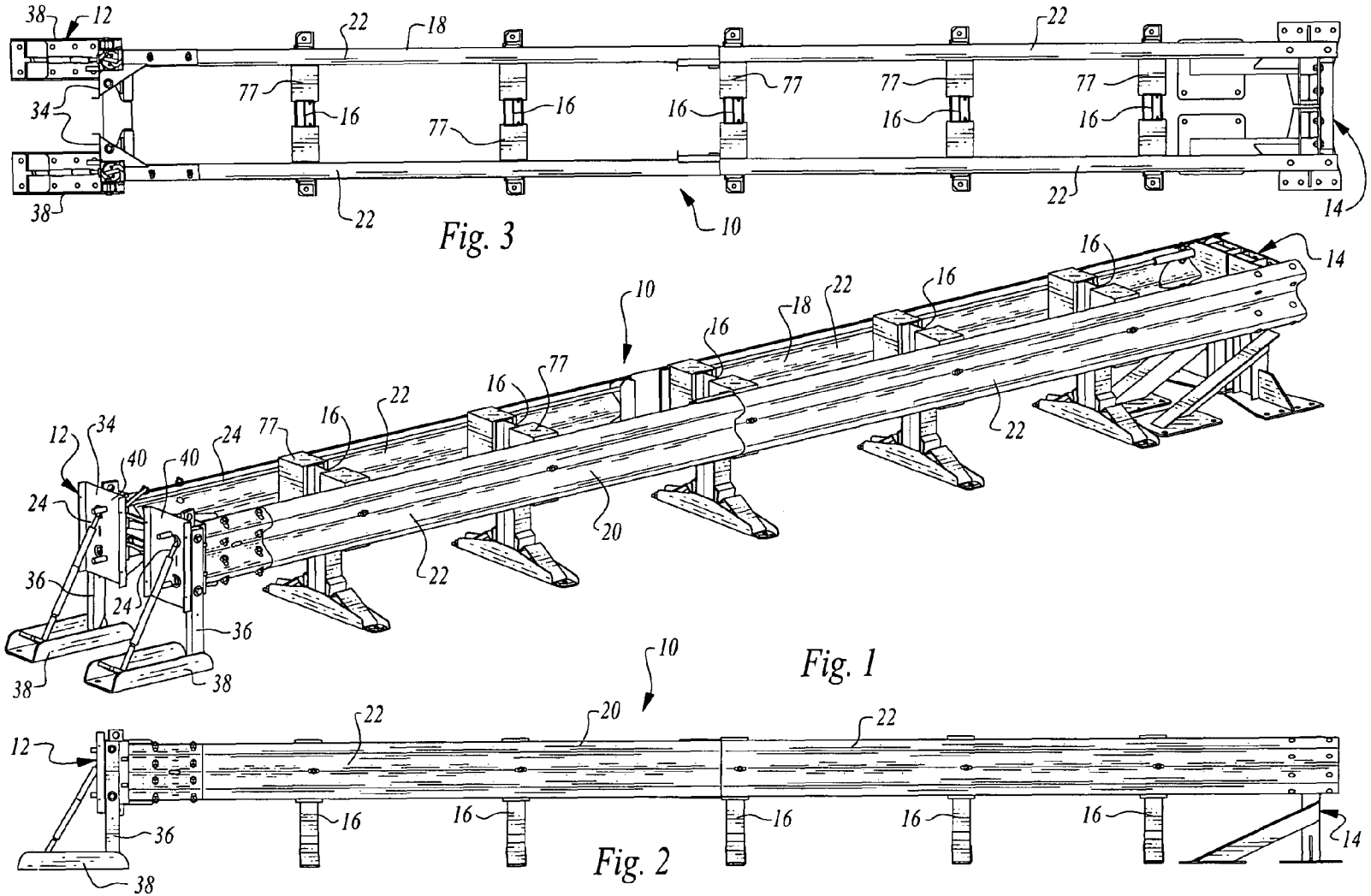
FIG. 1 is a perspective view of crash attenuator apparatus constructed in accordance with the teachings of the present invention.
FIG. 2 is a side, elevational view of the apparatus.
FIG. 3 is a top, plan view of the apparatus.

Referring now to the drawings, crash attenuator apparatus constructed in accordance with the teachings of the present invention is designated by reference numeral 10. Apparatus 10 includes impact head structure 12 attached to the ground. Backstop structure 14 is attached to the ground and extends upwardly from the ground.

A plurality of guardrail supports 16 extend upwardly from the ground and are disposed between the impact head structure and the backstop structure. The guardrail supports 16 are spaced from one another.

Two guardrails 18, 20 extend between the impact head structure 12 and the backstop structure 14, the guardrails spaced from one another and substantially parallel to one another. The guardrails 18, 20 each include a plurality of interconnected guardrail sections 22 supported by the guardrail supports in a manner to be described in detail below. The guardrail sections 22 have overlapping ends. In the arrangement illustrated, each guardrail has two guardrail sections but greater numbers of sections may be employed in the guardrail as desired and depending upon the circumstances. The guardrails have a generally W-shaped cross-section which is a well known guardrail configuration per se.

Two cables 24 extend between the impact head structure and the backstop structure, one cable being disposed alongside guardrail 18 and one cable being disposed alongside guardrail 20.

Impact head structure 12 includes an impact head 30 and an impact head support 32 attached to the ground and supporting the impact head above the ground. Impact head 30 has a front or vehicle impact side 34. Impact head support 32 includes two support columns 36 and two cable anchors 38 which are spaced apart from one another and engage and support the support columns 36, the support columns being connected to the cable anchors by frangible connectors (not shown) or any other suitable structure that allows separation of the columns from the cable anchors upon application of forces of predetermined magnitude. The cable anchors 38 extend along the ground forwardly of the impact head and are suitably attached to the ground by threaded fasteners (not shown) screwed into place in threaded sockets (not shown) embedded in the ground. Other modes of attachment may be utilized, for example by chemical or mechanical bonding to a roadway or other foundation.

Impact head 30 has two separate and spaced impact head portions 40, one portion 40 disposed above an end of one of the cable anchors 38 and the other impact head portion 40 disposed over an end of the other cable anchor 38.

Figure 4:
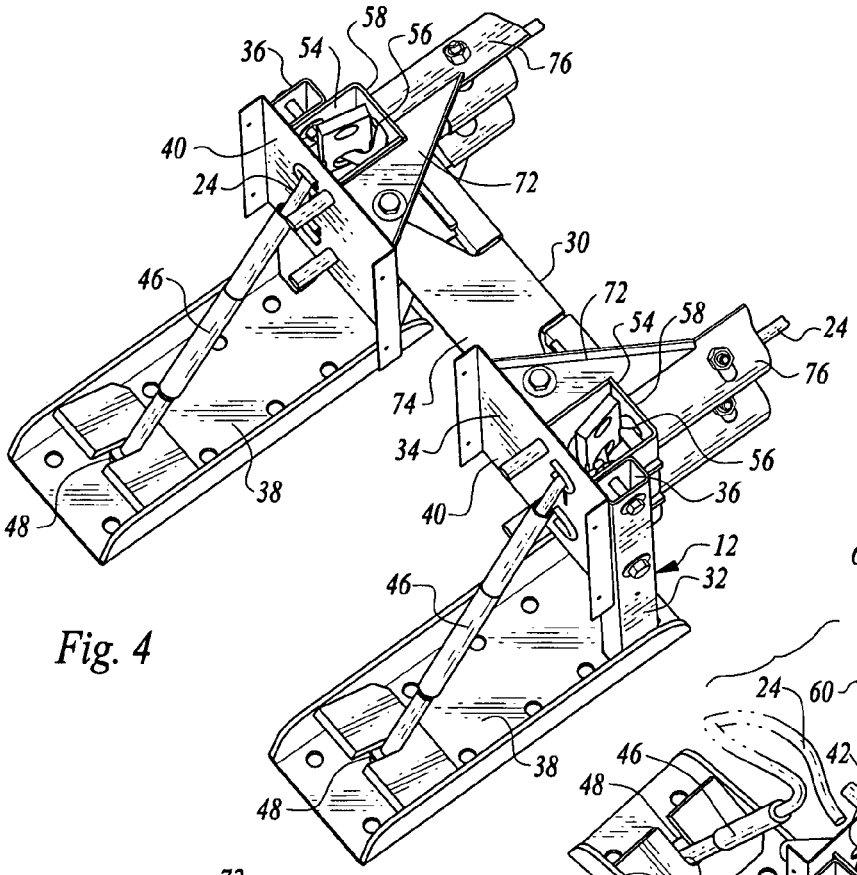
FIG. 4 is an enlarged, perspective view illustrating impact head structure of the apparatus along with portions of guardrails and cables employed in the apparatus.
Figure 7:
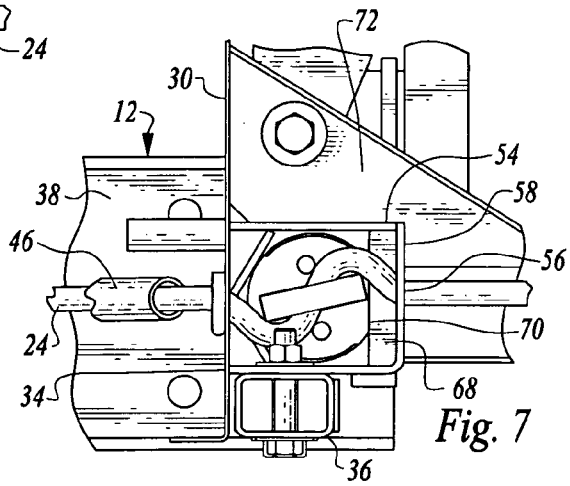
FIG. 7 is a view similar to FIG. 6, but illustrating the cable engagement structure in frictional engagement with the cable and forming a tortuous path for the cable.

Each cable head portion defines an opening 42 through which a cable end portion of a cable 24 projects, the cable end portion projecting as shown in FIGS. 4 and 7 for example, forwardly of and downwardly from the impact head portion and connected to a cable anchor 38 closely adjacent to the ground.

A cable assembly is attached to each cable end portion and includes a cable protector 46 having one or more tubular elements surrounding the cable end portion for protecting the cable end portion from vehicular damage and a cable connector 48 connecting the cable end portion to the cable anchor associated therewith.

In the disclosed embodiment, the cable connectors 48 associated with cables 24 comprise enlargements disposed at the distal ends thereof. Each cable anchor defines an open ended slot or recess 50 which receives a cable end portion with the enlargement or cable connector 48 in frictional engagement with the associated cable anchor to releasably retain the cable anchor portion in the recess when the associated cables 24 is under tension. As will be seen below, the other ends of the cables 24 are attached to the backstop structure and the cables are generally always maintained under tension to at least some degree.

Welded or otherwise fixedly attached to each impact head portion at the innermost or non-impact side thereof is cable engagement structure in frictional engagement with the cable associated with the impact head portion and in operative association with the impact head to exert frictional forces on the cable to control and resist movement of the impact head toward the backstop structure caused by a vehicle crashing into the front or impact side of the impact head.

Referring now to FIGS. 4-7 in particular, a housing 54 is attached to each impact head portion 40 and projects rearwardly therefrom. The interior of the housing communicates with opening 42 formed in each impact head portion. The associated cable 24 extends through an opening 56 formed in a wall 58 of the housing and then extends to the backstop structure as previously described.

Rotatably positioned within the interior of the housing 54 is a cable engagement member 60 having an upwardly extending protrusion 62 defining a throughbore 64 through which the cable 24 is threaded. If throughbore 64 aligns with openings 42 and 56, the associated cable 24 can readily move through the housing 54 and cable engagement member 60. When, however, the cable engagement member 60 is rotated, a tortuous pathway for the cable is formed.

Figure 6:
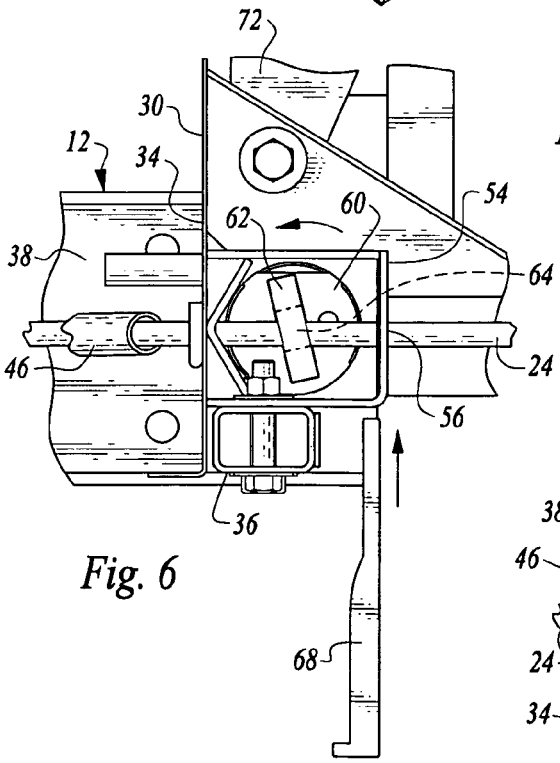
FIG. 6 is a greatly enlarged, top plan view illustrating a length of cable extending through the impact head structure and through the cable engagement structure, the structural elements of the cable engagement structure being shown in the positions assumed thereby just prior to forming a tortuous path for the cable and prior to applying frictional forces thereto.

FIG. 6 shows the cable engagement member slightly rotated from its non-frictional engagement position and FIG. 7 shows the cable engagement member move fully rotated so that the throughbore 64 thereof forms over a ninety degree angle with the axis of the openings 42 and 56. In the position shown in FIG. 7, bends are formed in the cable and frictional engagement between the housing, the cable engagement member 60 and the cable create significant frictional forces on the cable to control and resist movement of the impact head toward the backstop structure.

Figure 5:
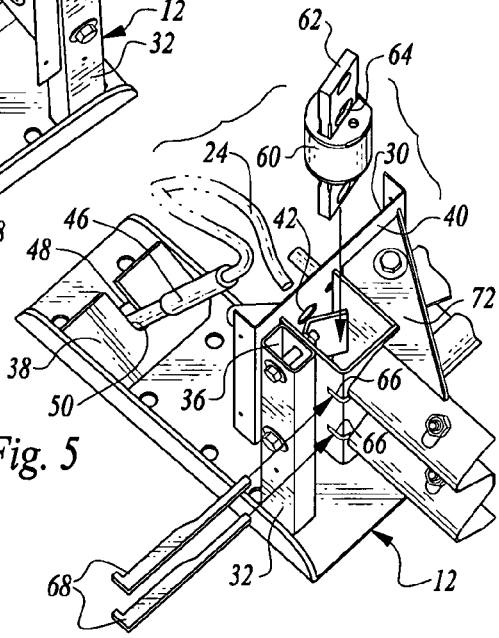
FIG. 5 is a perspective view of a portion of the impact head structure and cable engagement structure attached thereto.

Slots 66 are formed at the outer corners of housing 54 which receive locking bars 68. FIGS. 5 and 6 illustrate the locking bars just prior to insertion into the slots 66, and FIG. 7 shows the top most locking bar engaging a flat surface 70 of the cable engagement member to lock it in the position shown in FIG. 7. If desired, several separate flat surfaces may be employed on the periphery of the cable engagement member so that it may be adjusted and locked in positions providing various degrees of frictional resistance to the cable.

Welded or otherwise fixedly secured to the back sides of the impact head portions are gussets 72. A head support member 74 extends between the two gussets 72 and is secured thereto as by means of bolts. Projecting outwardly from the housings 54 and welded or otherwise secured thereto and to the gussets 72 are guardrail adaptors 76 which overlap and are attached to the adjacent ends of the guardrails, generally conforming to the shapes thereof.

Figure 8:
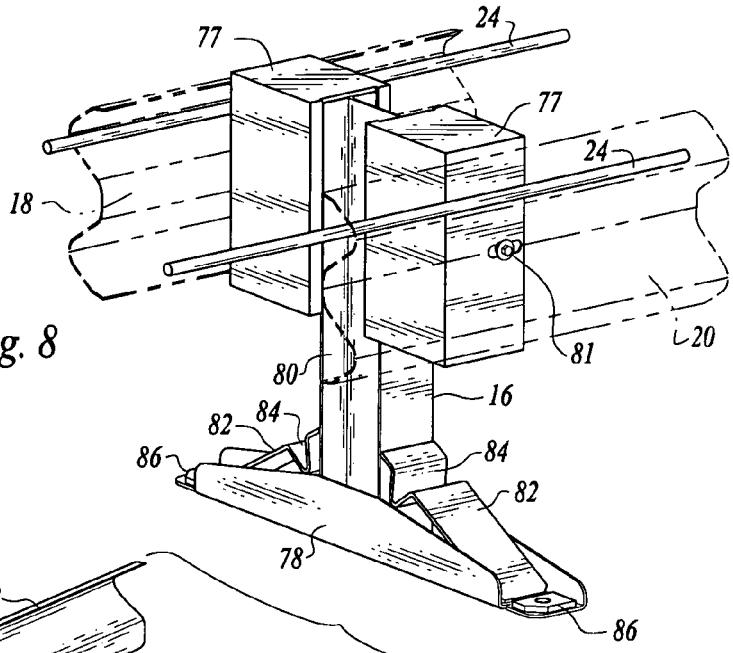
FIG. 8 is an enlarged, perspective view illustrating a guardrail support of the apparatus for supporting guardrails, portions of which are illustrated in phantom, the figure further illustrating portions of two cables employed in the crash attenuator apparatus.
Figure 9:
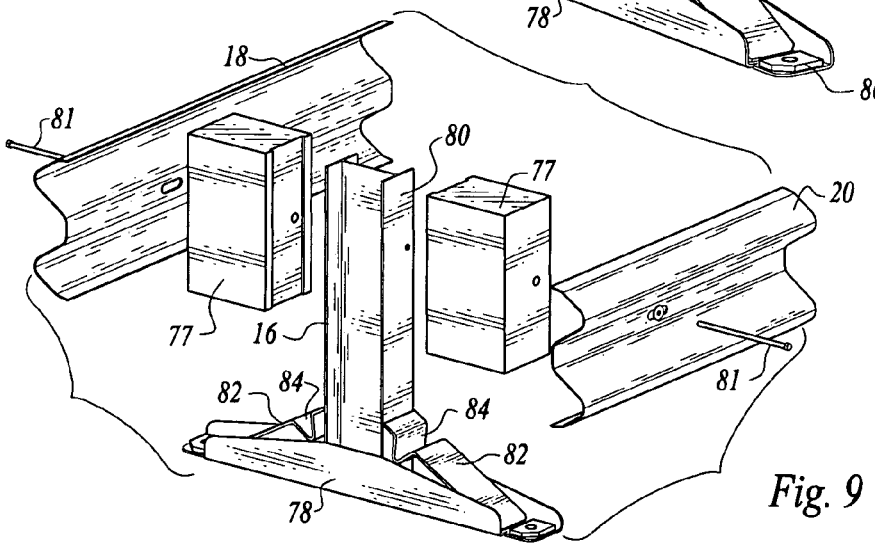
FIG. 9 is an exploded, perspective view of the structural elements shown in FIG. 8, the guardrail portions depicted by solid lines and prior to assembly with the guardrail support.

Cables 24 extend along the full lengths of the guardrails 18, 20 and terminal ends of the cables are affixed to backstop structure 14 in a manner to be discussed below. The cables are suitably nested in the elongated inwardly curved surfaces of the guardrails and positioned between the guardrails and block outs 77, suitably formed of wood, which comprise elements of the apparatus guardrail supports 16. Note FIGS. 8 and 12, for example. The blockouts may be tethered to hold them to supports 16.

Each guardrail support 16 also includes a guardrail support base 78, a guardrail support post 80 extending upwardly from the guardrail support base, and guardrail support brace structure bracing the guardrail support post to resist sideways tilting of the guardrail support post caused by vehicular impact on a side of the crash attenuator guardrail apparatus. The guardrails and the block outs are secured to the guardrail support post by frangible elongated bolts 81.

The guardrail support brace structure includes two double-ended brace members 82 disposed on opposed sides of the guardrail support post 80. Each double-ended brace member is secured at the ends thereof to the guardrail support base and to the guardrail support post at a location thereon spaced from the guardrail support base. Suitably this is accomplished by welding.

Figure 10:
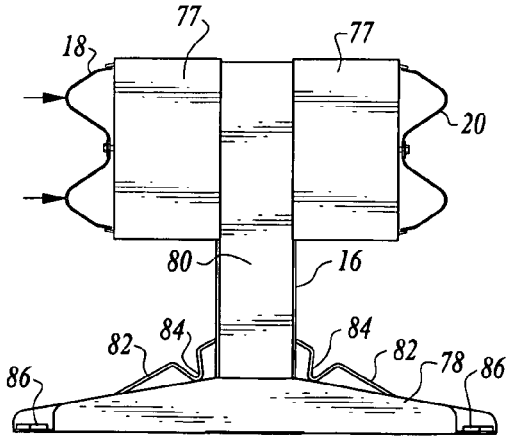
FIG. 10 is a front, elevational view of the guardrail support shown in its normal operational position, arrows designating forces beginning to be applied to a guardrail connected to the guardrail support.
Figure 11:
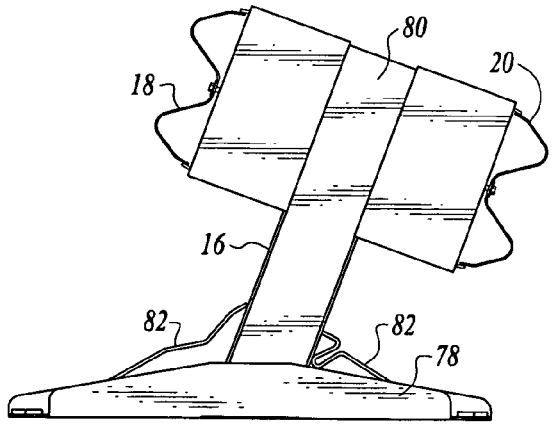
FIG. 11 illustrates the guardrail support being in tilted condition after the guardrail has been struck from the side by a vehicle.

It will be noted that each brace member 82 has bends formed therein which create a depression or indent 84 therein between the ends of the brace members. The upper gap formed by the depression enables the brace member to deform and overall length of each double-ended brace member between the ends thereof to shorten in response to opposed compressive forces being exerted at the ends thereof or the overall length of the brace member between the ends thereof to lengthen in response to opposed tensional forces being exerted at the ends thereof. If a guardrail associated with the guardrail support post of a guardrail support 16 is struck from the side as shown for example by the arrows in FIG. 10, the post will tilt in the direction of the force. FIG. 11 shows the guardrail support post leaning toward the right as a result of the crash forces directed to the right as depicted by the arrows in FIG. 10.

It will be noted that the left brace member as shown in FIG. 11 simultaneously has been subjected to tensional forces and has deformed and straightened out to a certain degree. On the other hand, the right brace member has partially collapsed, the ends thereof being closer together than when the brace member was in its normal configuration. Thus, the brace members have cooperated to absorb the side impact and have controlled and resisted to a certain extent tilting of the post, block outs and guardrails at the location of the tilted guardrail support post.

Figure 16:
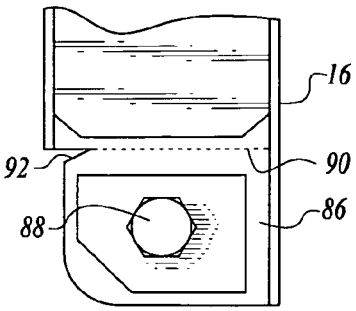
FIG. 16 is an enlarged, plan view illustrating a segment of the support base including a support base end portion attached to the ground by a mechanical fastener and frangibly connected to the rest of the support base.

The guardrail support base 78 of each guardrail support 16 has opposed guardrail support base end portions 86. The guardrail support base is only attached to the ground at the guardrail support base end portions, suitably by mechanical fasteners 88 as shown for example in FIGS. 14-16. These fasteners may be bolts threaded into sockets (not shown) imbedded in the ground. A line of weakness 90 is formed between each support base end portion and the remainder of the guardrail support base to provide a frangible connection therebetween. Also, as is shown in FIG. 16, the width of the guardrail support base is lessened at the location of the line of weakness by a notch at that location, the notch designed by reference numeral 92.

Figure 14:
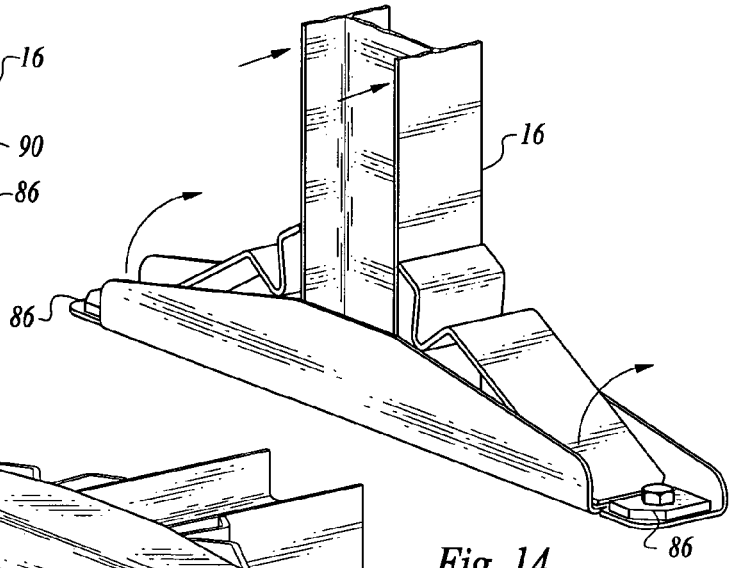
FIG. 14 illustrates a portion of a guardrail support including a lower end of a guardrail support post extending upwardly from the guardrail support base and guardrail support brace structure bracing both sides of the guardrail support, forwardly directed forces being applied to the guardrail support post as represented by arrows and applying tipping forces to the support base as represented by the curved arrows.
Figure 15:
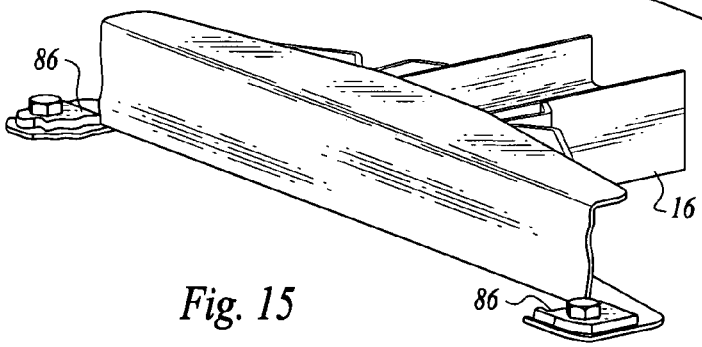
FIG. 15 is a perspective view of the structure shown in FIG. 14, but illustrating the support post knocked flat on the ground along with a center portion of the support base and brace members.

FIG. 14 illustrates a force applied to the guardrail support post from the front side or impact head side thereof as for example when a vehicle crashes into the impact head. If the force is great enough, the post will be knocked over to the position shown in FIG. 15. Due to the above-described line of weakness and notch features, the guardrail support base will also bend over as shown in FIG. 15 along with the brace members 82. The end portions will remain attached to the ground. This greatly simplifies and facilitates replacement of a damaged guardrail support with another, it merely being a matter of disconnecting the mechanical fasteners 88 from the ground without causing damage and reusing them to install a replacement guardrail support.

Figure 12:
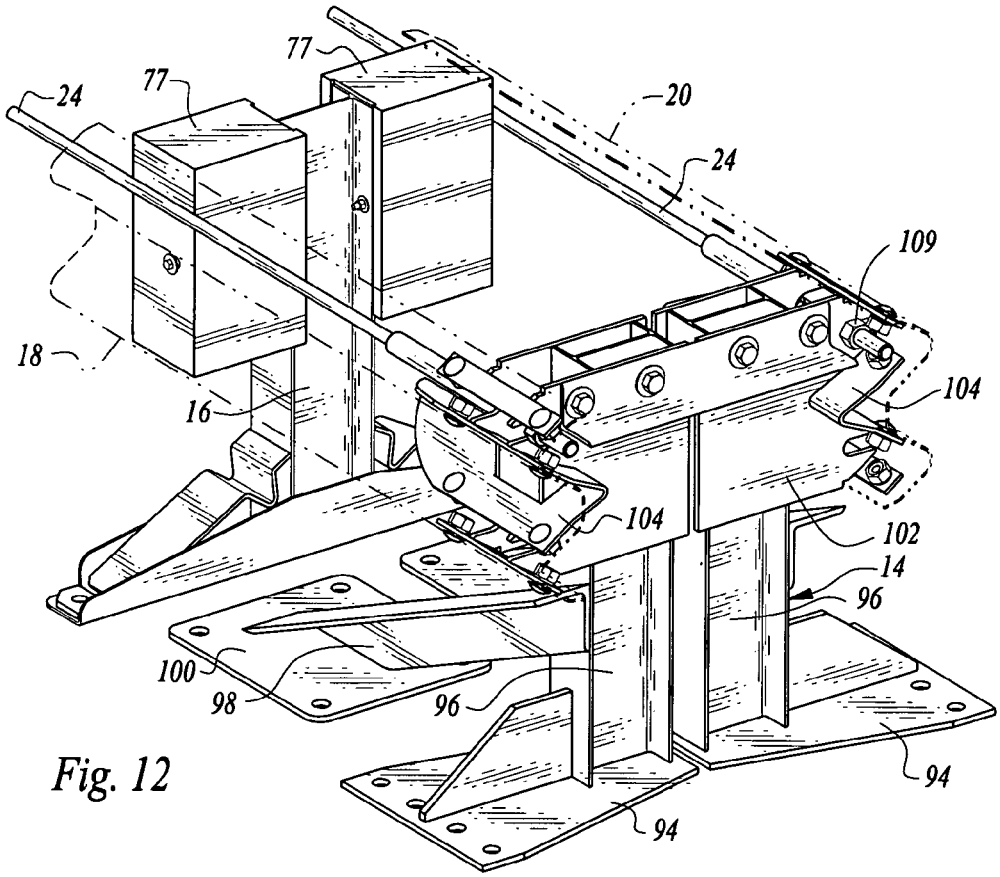
FIG. 12 is a rear, perspective view of the apparatus showing structural details of backstop structure, a guardrail support and cables of the crash attenuator apparatus in normal condition and free of impact forces being applied thereto.
Figure 13:
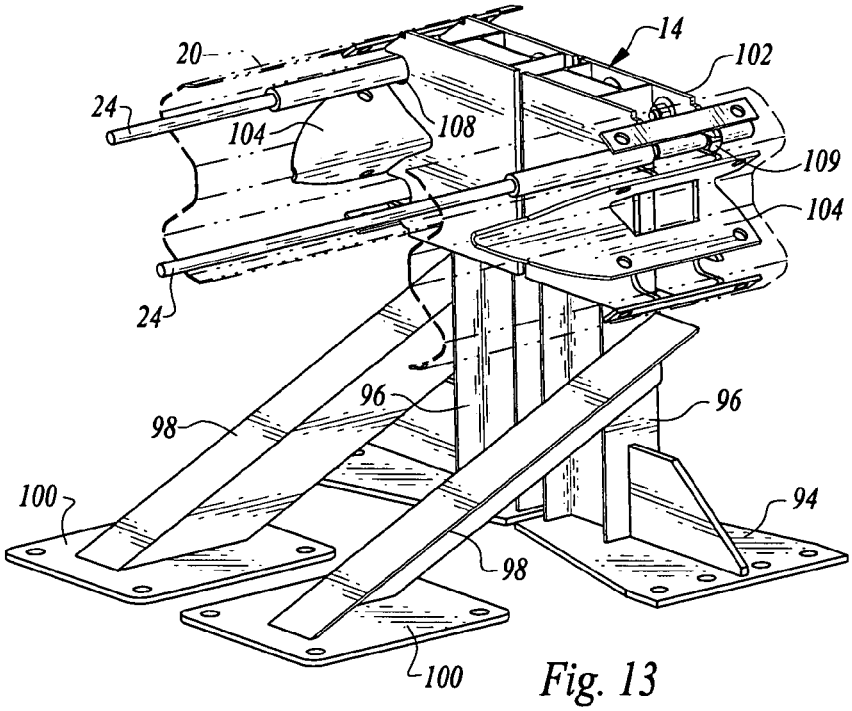
FIG. 13 is a front, perspective view of the backstop structure and cable portions attached thereto.

Now, and with particular reference to FIGS. 12 and 13, the elements and operation of the backstop structure 14 will now be described. The backstop structure 14 comprises a lower portion which comprises base plates 94 secured to the ground and the lower portions of backstop posts 96 attached to the base plates and extending upwardly therefrom. Inclined brace members 98 extend upwardly from adjacent brace bases 100 secured to the ground to the backstop posts 96. The portions of the backstop posts above the point of interconnection with the inclined brace members as well as all other structure of the backstop structure supported by the posts is to be considered and is hereinafter referred to as the backstop upper portion. The backstop upper portion is identified by reference numeral 102.

Figure 17:
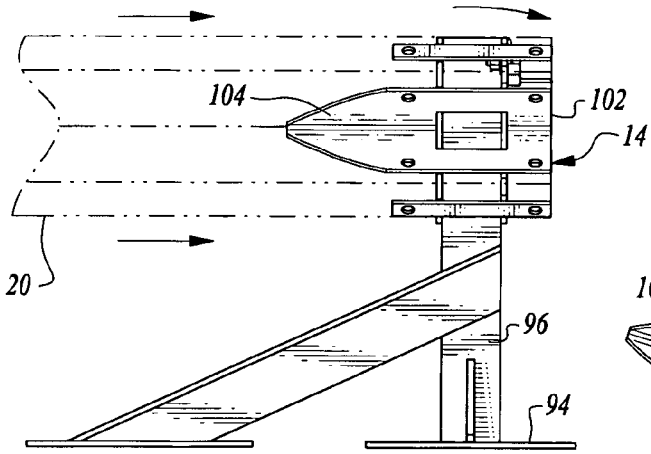
FIG. 17 is a side, elevational view of the backstop in normal operating condition.
Figure 18:
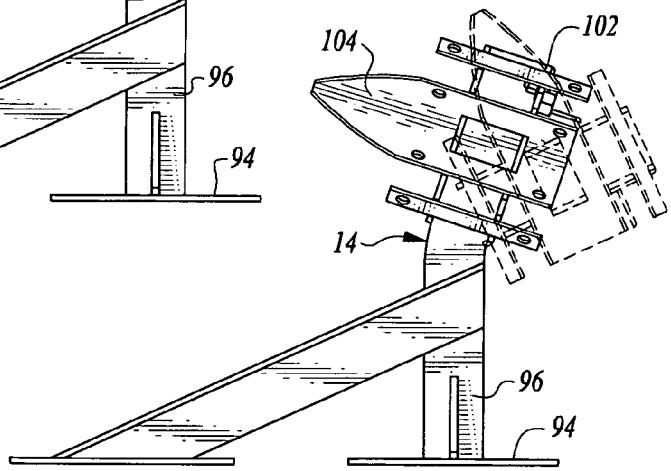
FIG. 18 is a view similar to FIG. 17, but illustrating the backstop having been deflected backwardly by forces resulting from excessive vehicular impact.
Figure 33:
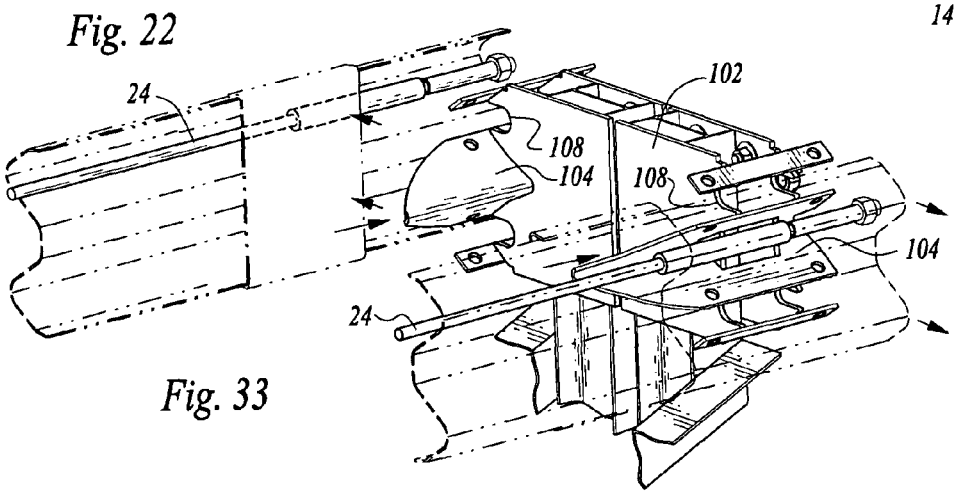
FIG. 33 is a view similar to FIG. 13, but illustrating the condition of the backstop structure and cable portions.
Figure 25:
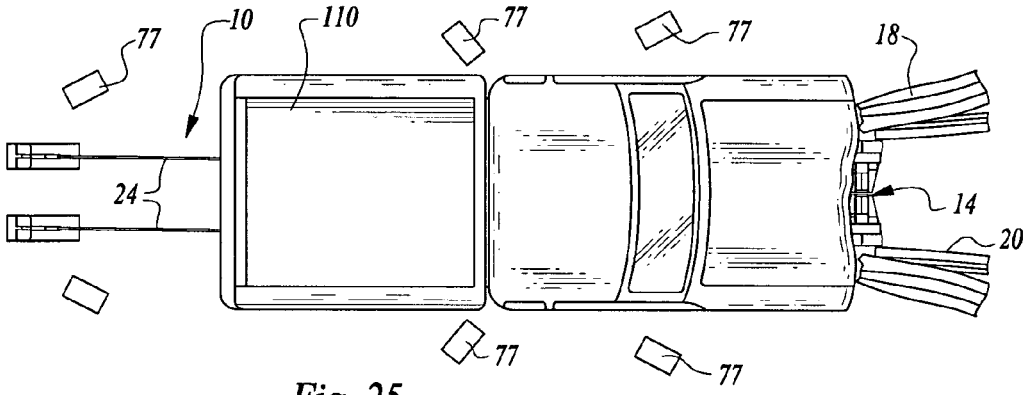
FIGS. 25 and 26 are, respectively, top plan and side, elevational views showing the vehicle impacting the backstop structure of the crash attenuator apparatus.
Figure 26:
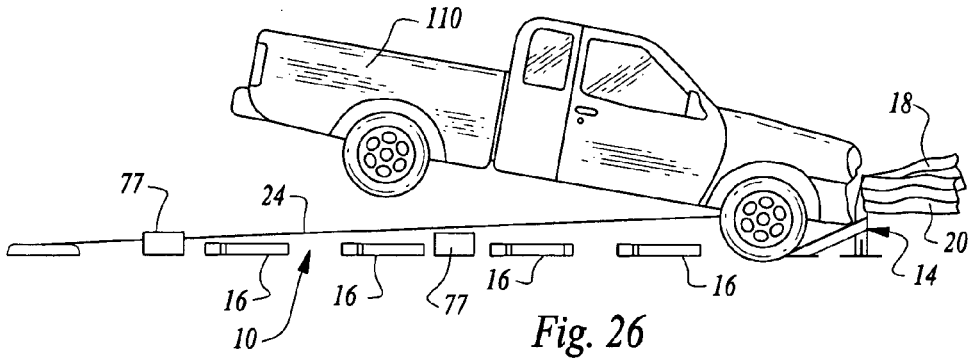

Distal ends of the cables 24 are attached to the backstop upper portion 102 by suitable hardware. More particularly, the cables are releasably connected to the backstop upper portion, the cable ends located in open-ended slots 108 formed at opposed ends of the backstop upper portion. Nuts 109 threaded to the cable ends maintain the tensioned cables located in the slots. The cables, as mentioned above, extend along and are encompassed by guardrails 18, 20. The guardrails (shown in phantom in FIGS. 12, 13 and 33) are attached to backstop wedge ramps or guides 104 at opposed sides of the backstop upper portion which have a generally V-shaped cross-section and which receive the inwardly directed upper bends of guardrails 18, 20 as shown. Connectors in the form of frangible bolts 106 and nuts provide an interconnection between the guides and guardrails which will be broken when sufficient shear forces exist between these two structural elements. That is, the endmost guardrail sections of the guardrails located at the backstop structure will separate from the backstop upper portion when forces of a predetermined magnitude are applied to the endmost guardrail section as a result of a vehicle colliding with the crash attenuator guardrail apparatus. The guides or wedge ramps 104 will direct movement of the guardrail sections caused by vehicular impact outwardly past the backstop structure, as shown in FIGS. 25, 26 and 33, so that they extend rearwardly of the backstop structure. Further, the cables are free to exit slots 108, as also shown in FIG. 33. In addition, a vehicle that has made its way down the crash attenuator guardrail apparatus and strikes the upper portion of the backstop structure will cause the backstop upper portion to deflect rearwardly relative to the backstop lower portion upon impact of a vehicle on the backstop upper portion. This is illustrated for example in FIG. 18, which can be compared to the normal condition of the backstop structure as illustrated in FIG. 17.

As indicated above, the crash attenuator apparatus of the present invention is highly effective as a crash attenuator or cushion whether impacted by a vehicle from the front or from the side.

FIGS. 19-26 illustrate sequentially the condition and operation of the apparatus from time of frontal impact by a vehicle to a point where the vehicle has impacted the backstop structure of the apparatus and come to a final halt. The apparatus brings the vehicle to a halt in a manner greatly lessening the damage caused to a vehicle or its occupants than would be the case where vehicle impact with an end of a conventional guardrail structure, barrier, or roadside hazard takes place.

Figure 19:
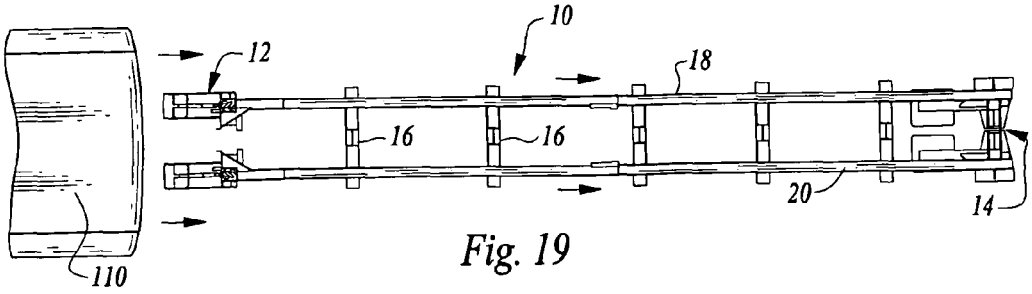
FIGS. 19 and 20 are, respectively, top plan and side, elevational views of the crash attenuator apparatus just prior to impact between a vehicle and the impact head structure.
Figure 20:
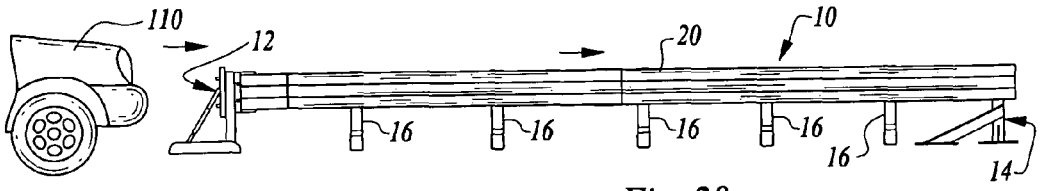
Figure 21:
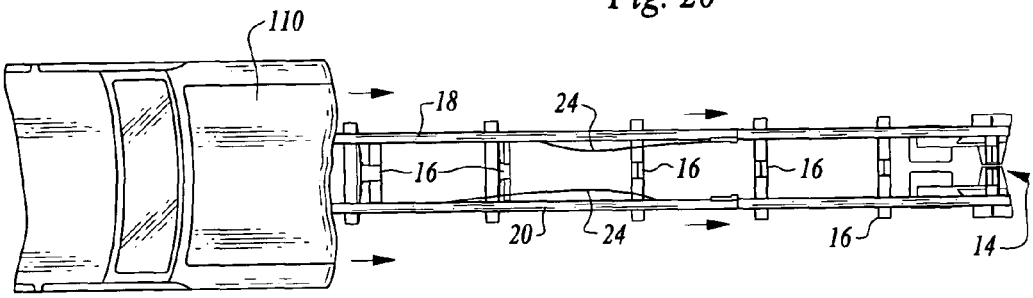
FIGS. 21 and 22 are, respectively, top plan and side, elevational views of the crash attenuator apparatus after impact between the vehicle and the apparatus.
Figure 22:
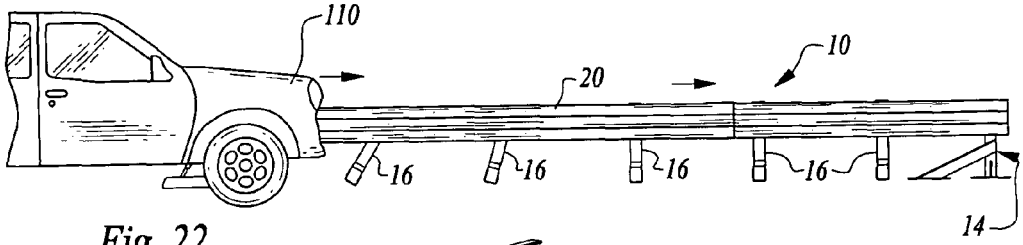

FIGS. 19 and 20 illustrate a vehicle 110 just prior to head-on impact with the impact head structure of the apparatus. FIGS. 21 and 22 illustrate the situation after the vehicle has struck the impact head structure and is in the process of displacing the impact head in the direction of the backstop structure. The impact head movement is controlled and resisted by the cables passing through the tortuous pathways defined by the cable engagement structure attached to each impact head portion 40, but the impact head moves rearwardly and results in shearing of the front guardrail sections of the guardrails 18, 20 from their supports, in the process also beginning knock down of the guardrail supports. These structural features effectively cooperate to disperse and absorb forces caused by the head-on crash.

Figure 23:
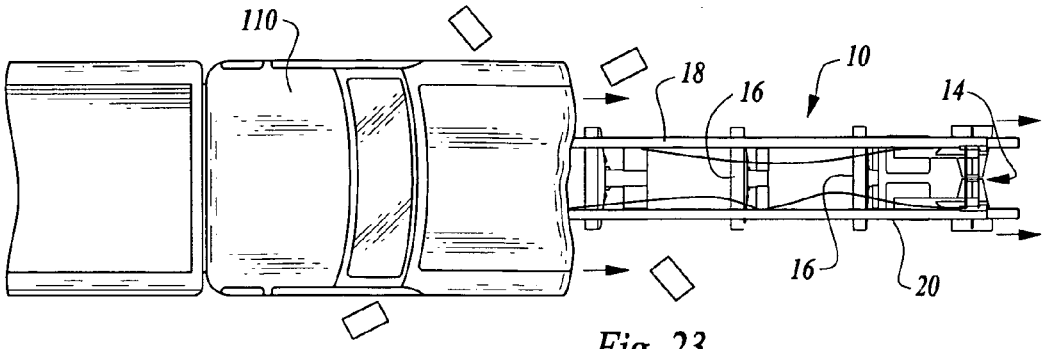
FIGS. 23 and 24 are, respectively, top plan and side, elevational views of the crash attenuator apparatus and vehicle continuing to move in the direction of the backstop structure.
Figure 24:
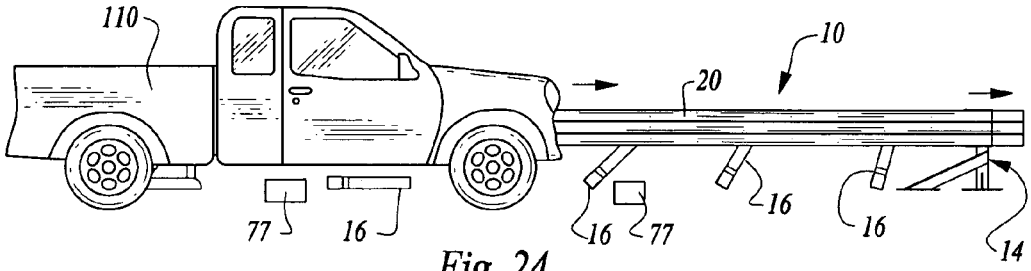

FIGS. 23 and 24 illustrate continued movement of the vehicle toward the backstop structure, virtually all of the guardrail supports having been knocked down or being in the process of being knocked down. In addition, the rearmost guardrail sections 22 of the guardrails are beginning to move rearwardly along with the frontmost guardrail sections.

FIGS. 25 and 26 illustrate the vehicle after it has engaged the backstop structure. It should be noted that the guardrails have been displaced rearwardly relative to the backstop structure and placed in a position wherein they will not be likely to cause damage to the vehicle or the occupants.

FIGS. 27-32 illustrate the structure and functioning of the crash attenuator apparatus during a side impact. It will be seen that the impact forces are rapidly absorbed and attenuation takes place to re-direct the vehicle back away from the crash attenuator apparatus and not allow gating to occur. Again, the cables, the guardrails and the guardrail supports cooperate in a unique manner to disperse and absorb forces in a manner protective of the vehicle and its occupants.

Figure 27:
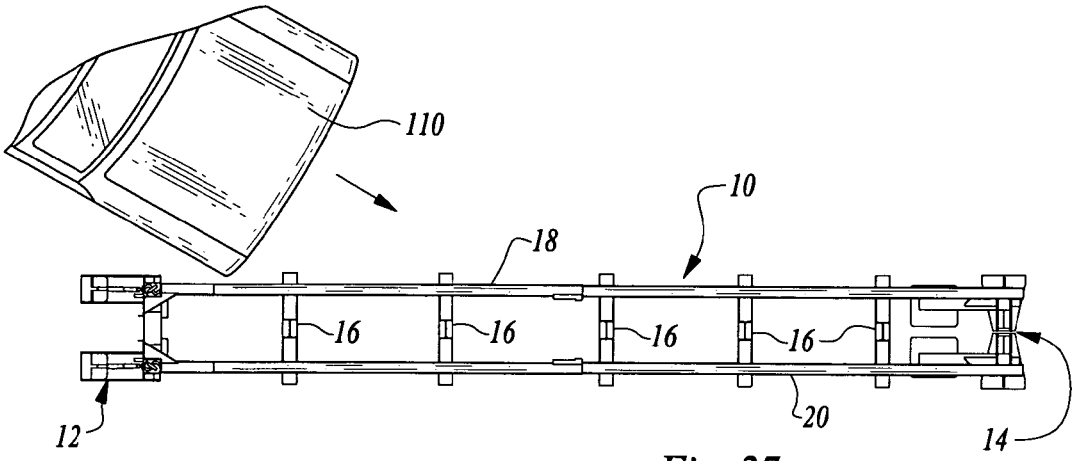
FIG. 27 is a top plan view of the crash attenuator apparatus just prior to impact by a vehicle on a side of the apparatus.
Figure 28:
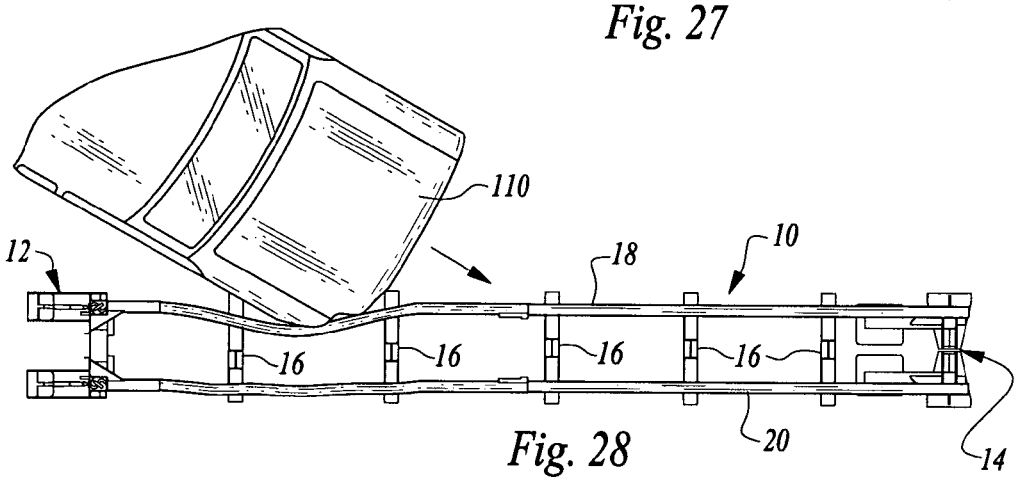
FIG. 28 is a view similar to FIG. 27, but illustrating initial impact by the vehicle.
Figure 29:
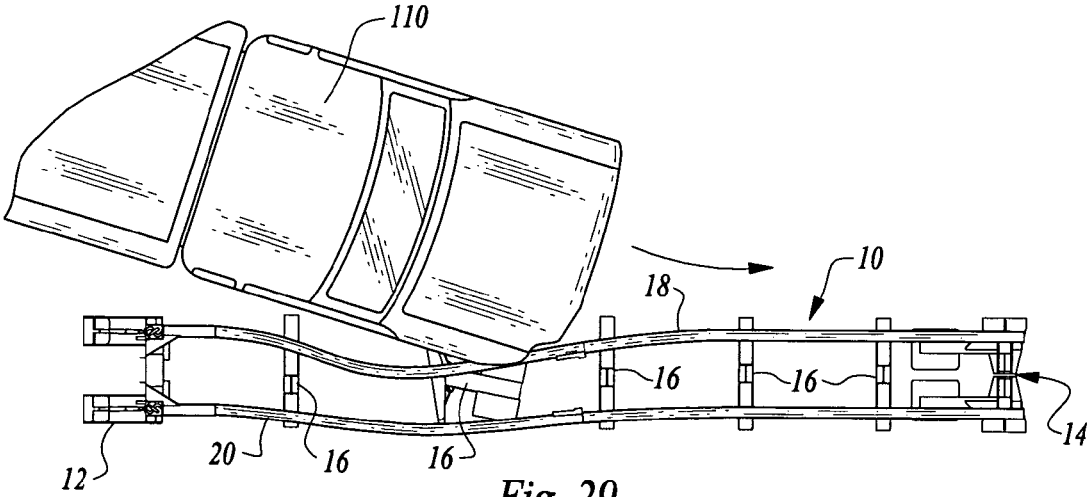
FIG. 29 is a view similar to FIG. 28, but illustrating the vehicle moving forwardly along the crash attenuator apparatus and being diverted in a forward vehicle direction.

FIG. 27 illustrates a vehicle approaching a side of the apparatus behind the impact head structure. FIG. 28 shows the initial conditions immediately after impact. FIG. 29 illustrates how the course of the vehicle is being redirected without having passed or even reached the guardrail not on the side of impact, one or both of the cables, depending upon severity of the crash, being an important factor in bringing about such redirection.

Figure 30:
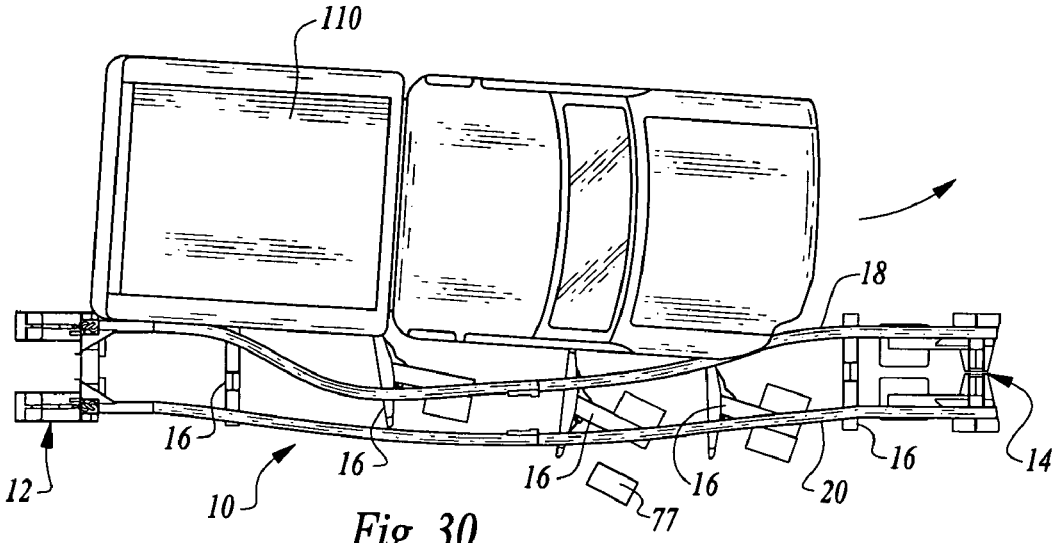
FIG. 30 is a top plan view illustrating the vehicle continuing to move forwardly, but moving generally parallel to the crash attenuator apparatus and still being in the process of being diverted in the direction of the arrow.
Figure 31:
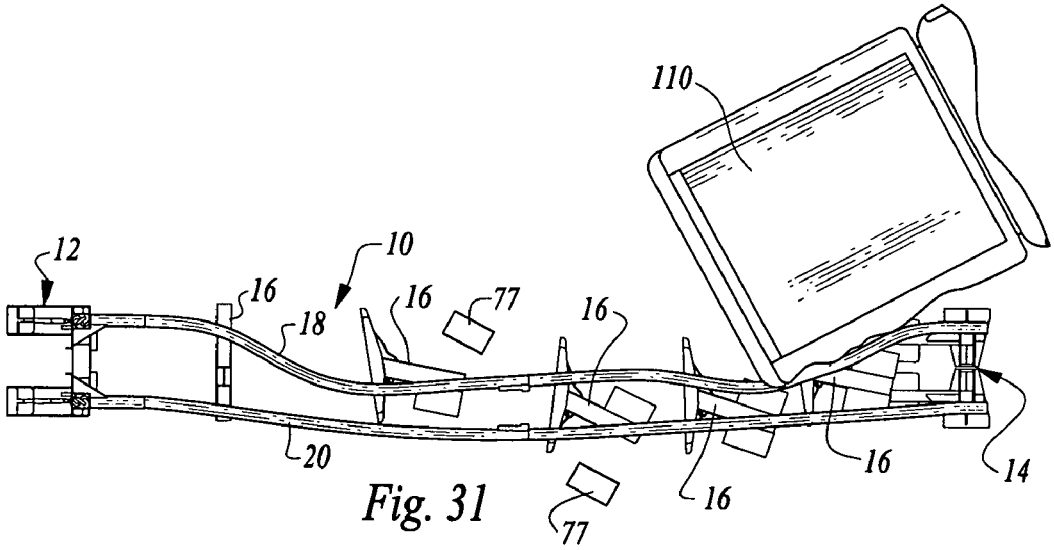
FIG. 31 is a top plan view illustrating the condition of the crash attenuator apparatus after impact with the vehicle in the process of moving away from the apparatus.
Figure 32:
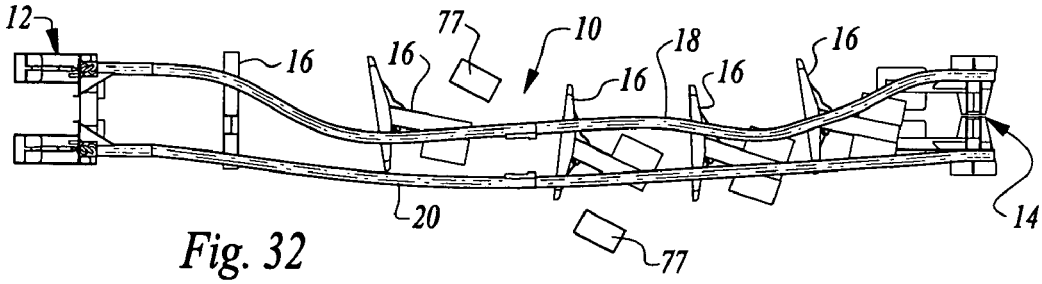
FIG. 32 is a top plan view illustrating the condition of the crash attenuator apparatus after the vehicle has moved away from the apparatus.

FIG. 30 illustrates the vehicle having been directed to a position almost parallel to the main axis of the apparatus. FIG. 31 shows the vehicle now being redirected completely away from the apparatus prior to reaching the backstop structure. FIG. 32 provides an illustration of the crash attenuator apparatus after termination of the collision event.

The invention claimed is:

1. A crash attenuator apparatus including a guardrail support extending upwardly from the ground, said guardrail support including a guardrail support base, a guardrail support post extending upwardly from said guardrail support base and a guardrail support brace structure bracing said guardrail support post to resist and control sideways tilting movement of said guardrail support post caused by vehicular impact on the crash attenuator apparatus from the side, said guardrail support post supporting two spaced, substantially parallel guardrails located on opposite sides of said guardrail support post and extending to adjacent guardrail support posts, said guardrail support brace structure including two double-ended brace members located at opposed sides of said guardrail support post and extending laterally relative to said guardrails, each double-ended brace member being of deformable, single piece, unitary construction and secured at the ends thereof to the guardrail support base and to the guardrail support post at a location thereon spaced from the guardrail support base, said guardrail support base extending laterally relative to said guardrails and said double-ended brace members attached to said guardrail support base at locations on said guardrail support base spaced from said guardrail support post and disposed on opposite sides of said guardrail support post and attached to said guardrail support post at locations on opposite sides of said guardrail support post below the guardrails supported by the guardrail support post, each said double-ended brace member having bends formed therein between said guardrail support post and said guardrail support base which deform enabling the overall length of said double-ended brace member between the ends thereof to shorten in response to opposed compressive forces being exerted at the ends thereof and the overall length of said double-ended brace member between the ends thereof to increase in response to opposed tensional forces being exerted at the ends thereof, the overall length of one of said double-ended brace members shortening due to deformation at the bends thereof and the overall length of the other of said double-ended brace members simultaneously increasing due to deformation at the bends thereof when a guardrail supported by said guardrail support post is struck by a vehicle from the side whereby both of said double-ended brace members will simultaneously absorb impact energy and control sideways tilting of said guardrail support post, deformation of said double-ended brace members and controlled sideways tilting of said guardrail support post under load caused by a guardrail supported by said guardrail support post being struck from the side by a vehicle moving said guardrail support post in the direction of the non-impacted guardrail supported thereby to tension the non-impacted guardrail and provide a reactive force to redirect the impacting vehicle, and said guardrail support post being fixedly attached to a portion of said guardrail support base frangibly connected to the rest of said guardrail support base and responsive to longitudinal forces being applied to said crash attenuator caused by endwise vehicular impact thereon to cause knockdown of said portion and the guardrail support post attached thereto in a longitudinal direction upon breaking of the frangible connection.

2. The crash attenuator apparatus according to claim 1 wherein said guardrail support base has opposed guardrail support base end portions, the guardrail support base being securely attached to the ground by mechanical fasteners at said guardrail support base end portions, and the remainder of the guardrail support base between said end portions comprising the portion of said guardrail support base fixedly attached to said guardrail support post and not being securely attached to the ground by mechanical fasteners, said support base end portions being frangibly connected to the remainder of said guardrail support base whereby said support base end portions will remain attached to the ground by said mechanical fasteners even after said guardrail support post and the remainder of said guardrail support base between said support base end portions are knocked down as a result of vehicular impact.

3. The crash attenuator apparatus according to claim 2 wherein lines of weakness are formed in said guardrail support base between the support base end portions and the remainder of the guardrail support base and provide the frangible connection therebetween.

4. The crash attenuator apparatus according to claim 3 wherein the width of the guardrail support base is lessened at the locations of the lines of weakness by notches at ends of the lines of weakness.

* * * * *